US009701122B2

(12) United States Patent
Arimizu et al.

(10) Patent No.: US 9,701,122 B2
(45) Date of Patent: Jul. 11, 2017

(54) LIQUID EJECTING APPARATUS

(71) Applicant: CANON KABUSHIKI KAISHA, Tokyo (JP)

(72) Inventors: Hiroshi Arimizu, Kawasaki (JP); Masahiko Kubota, Tokyo (JP); Nobuhito Yamaguchi, Inagi (JP); Arihito Miyakoshi, Tokyo (JP); Koichi Ishida, Tokyo (JP); Yoshinori Itoh, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/073,757

(22) Filed: Mar. 18, 2016

(65) Prior Publication Data

US 2016/0271952 A1 Sep. 22, 2016

(30) Foreign Application Priority Data

Mar. 19, 2015 (JP) ..... 2015-056175
Feb. 16, 2016 (JP) ..... 2016-027008

(51) Int. Cl.
*B41J 2/165* (2006.01)
*B41J 2/17* (2006.01)
*B41J 2/08* (2006.01)

(52) U.S. Cl.
CPC ..... *B41J 2/1652* (2013.01); *B41J 2/1714* (2013.01); *B41J 2/08* (2013.01)

(58) Field of Classification Search
None
See application file for complete search history.

(56) References Cited

U.S. PATENT DOCUMENTS 8,356,881 B2 1/2013 Ohnishi
9,199,472 B2 12/2015 Ishida et al.
(Continued)

FOREIGN PATENT DOCUMENTS

CN 104401131 A 3/2015
JP 2000-062197 A 2/2000
(Continued)

OTHER PUBLICATIONS

Onishi, Masaru, Inkjet Printer (JP 2010137483 A—Machine Translation), Jun. 24, 2010, Paragraphs 0007, 0009, 0010, 0028, 0030-0033.*
(Continued)

*Primary Examiner* — Lisa M Solomon
(74) *Attorney, Agent, or Firm* — Fitzpatrick, Cella, Harper & Scinto

(57) ABSTRACT

A liquid ejecting apparatus includes a moving unit configured to make a relative movement between at least one liquid ejecting unit, having an ejection port for ejecting liquid, and a print medium. The liquid ejecting apparatus includes at least one mist removing unit provided downstream of the at least one liquid ejecting unit in a movement direction in which the print medium is moved in the case of relative movement. The mist removing unit includes at least one suction hole configured to suck air existing in a region defined by the liquid ejecting unit and the print medium together with mist, and at least one blowing hole that is formed downstream of the suction hole in the movement direction, with the blowing hole configured to blow air toward the print medium so as to generate a vortex of gas downstream of the suction hole.

19 Claims, 11 Drawing Sheets

(56) References Cited

U.S. PATENT DOCUMENTS

| | | | |
|---|---|---|---|
| 2006/0238561 | A1 | 10/2006 | Carcia et al. |
| 2013/0180245 | A1 | 7/2013 | Saddoughi et al. |
| 2015/0165770 | A1 | 6/2015 | Miyakoshi et al. |
| 2015/0273835 | A1 | 10/2015 | Arimizu et al. |
| 2016/0031218 | A1 | 2/2016 | Ishida et al. |

FOREIGN PATENT DOCUMENTS

| | | | |
|---|---|---|---|
| JP | 2005-271316 | A | 10/2005 |
| JP | 2006-315226 | A | 11/2006 |
| JP | 2010-137483 | A | 6/2010 |

OTHER PUBLICATIONS

Merriam-Webster Dictionary definition of Vortex, retrieved on [Oct. 3, 2016], Simple Definition of Vortex.*

Search Report in European Patent Application No. 16160191.9, dated Aug. 30, 2016.

* cited by examiner

LIQUID EJECTING APPARATUS

BACKGROUND OF THE INVENTION

Field of the Invention

The present invention relates to a liquid ejecting apparatus, in which a liquid ejecting unit ejects liquid, and furthermore, mist generated between a print medium and the liquid ejecting unit can be removed.

Description of the Related Art

In a liquid ejecting apparatus in which liquid is ejected onto a print medium so as to perform printing, fine liquid droplets called mist floating between a print head and the print medium without landing on the print medium are generated during liquid ejection as well as main droplets as liquid droplets contributive to image formation on the print medium. The mist adheres to various portions inside of the main body of the liquid ejecting apparatus such as the print medium and the print head on an airflow produced inside of the main body of the liquid ejecting apparatus. In a case where mist adheres to, in particular, a surface (i.e., an ejection port surface), at which an ejection port for ejecting ink therethrough is formed, of the print head in a large quantity, the mist coalesces to become a large liquid droplet, which closes the ejection port, possibly resulting in deficient ejection of the ejection port. In this case, the ejection performance of the print head is markedly reduced. This is a factor of degradation of a print image. Moreover, in a case where the mist adheres to a portion which is brought into direct contact with the print medium such as a pinch roller, the ink adheres to the print medium, thereby degrading an image.

In order to solve the above-described problem caused by mist, mist floating between a print head and a print medium has been sucked through a suction hole. However, in a case where the liquid ejecting apparatus is configured such that air is sucked by using only the suction hole, an airflow is produced toward the suction hole, and therefore, the landing position of a main droplet ejected from an ejection port is misregistered by the influence of the airflow.

In view of the above, Japanese Patent Laid-open No. 2010-137483 and U.S. Patent Laid-open No. 2006238561 disclose blowing and sucking air between a print head and a print medium in a liquid ejecting apparatus so as to remove mist on an airflow.

However, in an apparatus disclosed in Japanese Patent Laid-open No. 2010-137483, in a case where an airflow is produced in a large quantity by sucking and blowing air, the landing position of a liquid droplet ejected from the print head is misregistered from a proper landing position by the influence of the airflow, possibly resulting in degrading an image. To the contrary, in a case where air is sucked and blown in a small quantity, the mist cannot be sufficiently removed, whereby the mist possibly causes a smudge.

Moreover, in an apparatus disclosed in U.S. Patent Laid-open No. 2006238561, mist is removed by using both a suction hole and a blowing hole that are formed between adjacent print heads, thereby suppressing the production of an airflow that may degrade an image. However, even the technique disclosed in U.S. Patent Laid-open No. 2006238561 cannot remove mist in a case where air is sucked or blown within a predetermined range of quantities, thus preventing satisfactory elimination of a smudge on component parts caused by the adhesion of the mist.

As described above, the conventional liquid ejecting apparatuses, in which the mist can be removed while both of sucking and blowing operations are optimized, require trial and error using an actual device or in simulation. A definite measure or the like has not been found yet.

SUMMARY OF THE INVENTION

An object of the present invention is to provide a liquid ejecting apparatus capable of efficiently removing mist generated between a liquid ejecting unit and a print medium.

The present invention is directed to a liquid ejecting apparatus including a moving unit configured to make a relative movement of at least one liquid ejecting unit having an ejection port for ejecting liquid and a print medium placed at a predetermined interval with respect to the liquid ejecting unit, including: at least one suction hole that is formed downstream of the liquid ejecting unit in a movement direction in which the print medium is moved in the case of the relative movement, as viewed from the liquid ejecting unit, the suction hole sucking air existing in a region defined by the liquid ejecting unit and the print medium together with mist; and at least one blowing hole that is formed downstream of the suction hole in the movement direction, the blowing hole blowing air toward the print medium so as to generate a vortex of gas downstream of the suction hole, wherein a relationship expressed by the following expression is satisfied:

$$\gamma \geq h/3 \qquad \text{Mathematic Formula 1}$$

where $\gamma$ represents a maximum vortex core radius (mm) of the vortex in a direction perpendicular to the print medium and h represents a distance (mm) between the blowing hole and the print medium.

According to the present invention, the mist generated between the liquid ejecting unit and the print medium can be efficiently removed, thus reducing a smudge on the liquid ejecting apparatus or the print medium caused by the mist.

Further features of the present invention will become apparent from the following description of exemplary embodiments (with reference to the attached drawings).

DESCRIPTION OF THE EMBODIMENTS

First Embodiment

An embodiment according to the present invention will be described in detail with reference to the attached drawings.

Figure 1A:
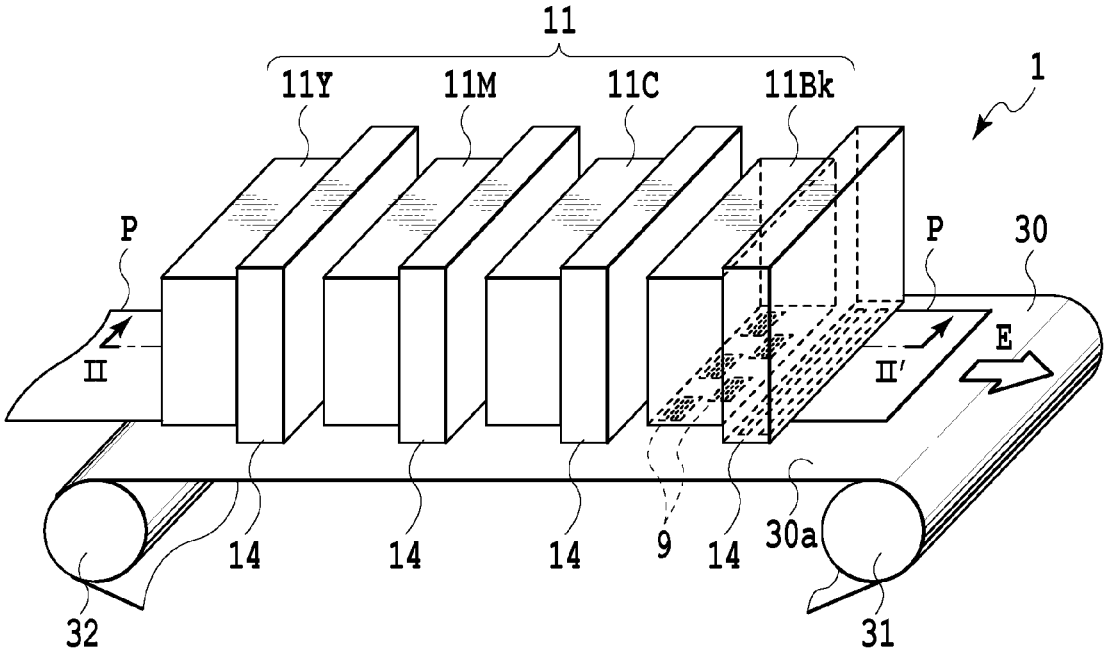
FIG. 1A is a perspective view schematically showing the configurations of essential parts of a liquid ejecting apparatus in an embodiment according to the present invention.
Figure 1B:
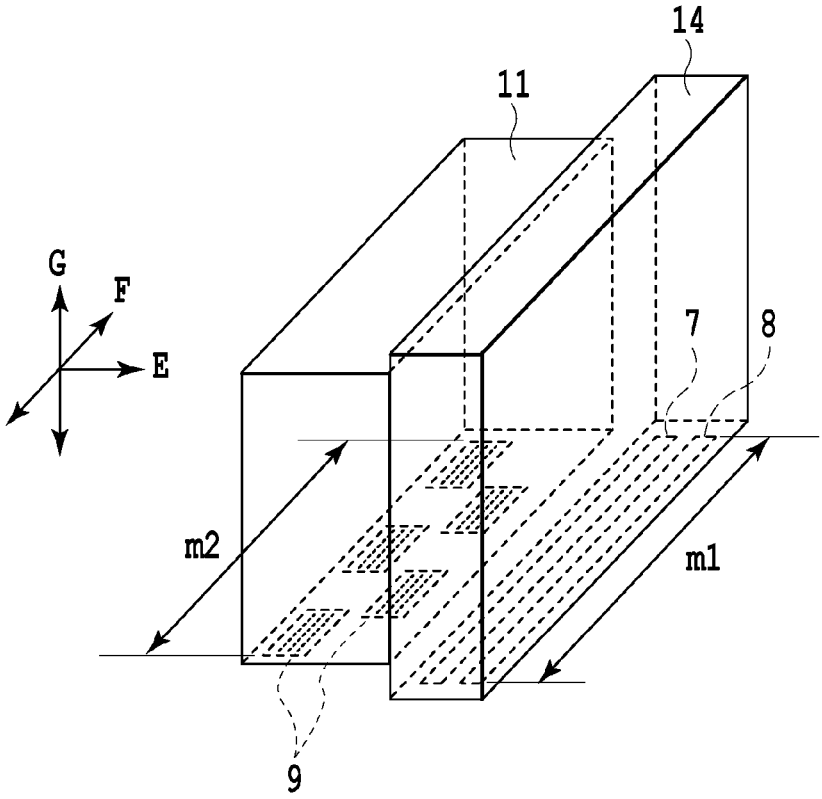
FIG. 1B is a perspective view showing the configuration and arrangement of a liquid ejecting unit (i.e., a print head) and a mist removing head shown in FIG. 1A.

FIG. 1A is a perspective view schematically showing the configurations of essential parts of a liquid ejecting apparatus that is applied to an embodiment according to the present invention; FIG. 1B is a perspective view showing the configuration and arrangement of a liquid ejecting unit (i.e., a print head) and a mist removing head shown in FIG. 1A; and FIG. 2 is a vertical side view schematically showing the arrangement of the print head and the mist removing head shown in FIG. 1A, taken along a line II-II'.

Figure 2:
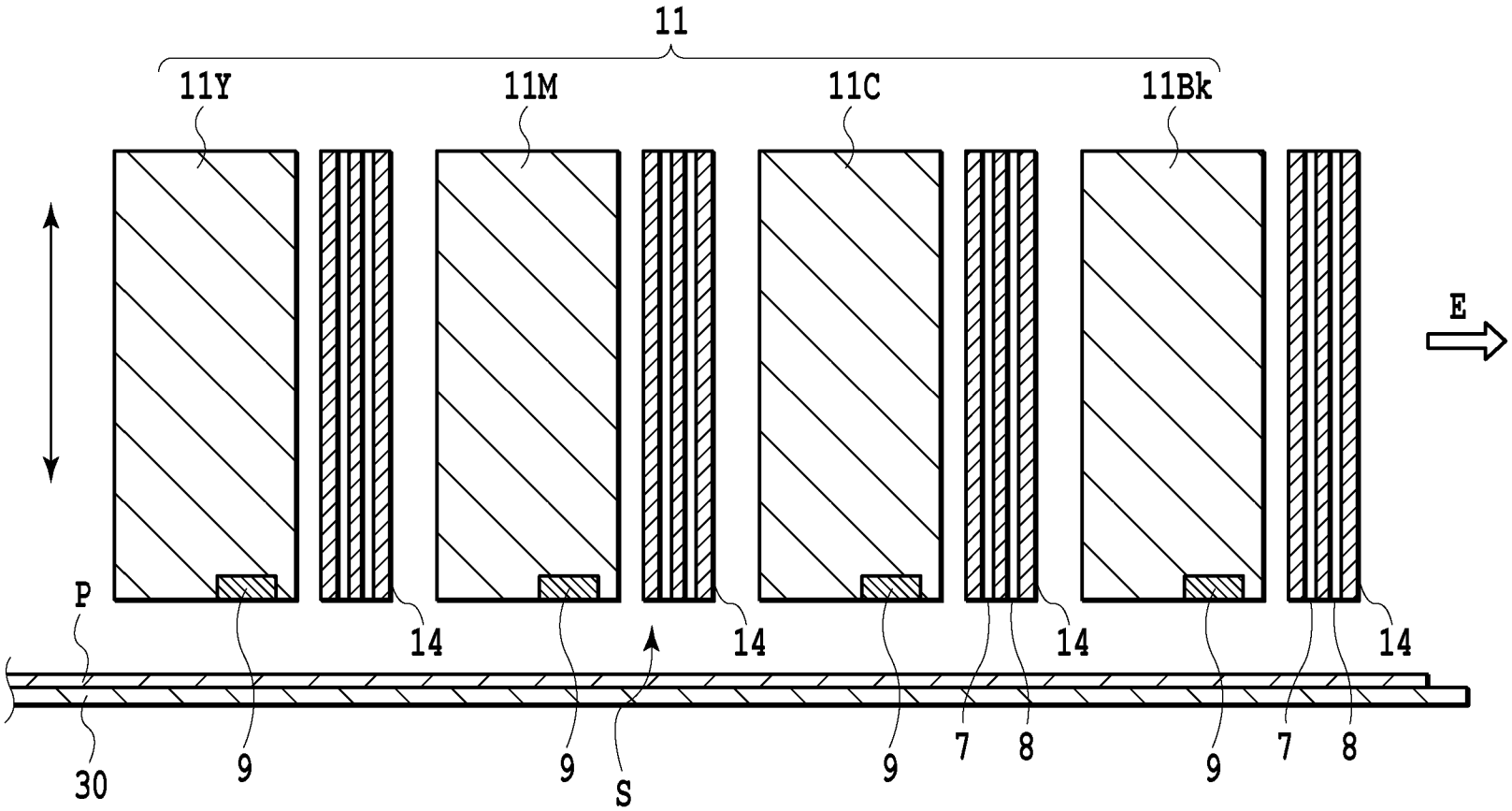
FIG. 2 is a vertical side view schematically showing the arrangement of the print head and the mist removing head shown in FIG. 1A, taken along a line II-II.

In FIG. 1A, FIG. 1B, and FIG. 2, a liquid ejecting apparatus 1 in the present embodiment is a full-line type ink jet printing apparatus in which a plurality of elongated print heads 11Y, 11M, 11C, and 11Bk extending in a planar direction (i.e., a direction F) perpendicular to a movement direction (i.e., a direction E) of a print medium P are arranged in parallel with each other. Here, reference numeral 11Y designates a print head for ejecting yellow ink, serving as a liquid ejecting head; 11M, a print head for ejecting magenta ink; 11C, a print head for ejecting cyan ink; and 11Bk, a print head for ejecting black ink. All of the print heads have substantially the same configuration except that the type of ink to be supplied is different. These print heads are collectively called print heads 11 in the following description in a case where there is no need to particularly distinguish these print heads from each other. The print heads 11 are connected to four ink tanks, not shown, reserving therein yellow ink, magenta ink, cyan ink, and black ink, respectively.

The plurality of print heads 11 are arranged at predetermined intervals in a direction in which the print medium P and the print heads 11 are moved relatively to each other in such a manner as to face the upper surface of an endless conveyance belt 30 disposed in a conveyance unit (i.e., a movement unit) for conveying the print medium P. In the present embodiment, the print heads 11 are held at constant positions during a printing operation while the print medium P is conveyed by the conveyance belt 30. Therefore, the print medium P and the print head 11 are relatively moved in a direction in which the print medium P is conveyed by the conveyance belt 30 (i.e., a conveyance direction, that is, the direction E). Head chips 9, at which a plurality of ejection ports for ejecting liquid are arrayed, are arranged in a zigzag manner in a longitudinal direction (i.e., the direction F) of the print head at a surface facing an upper surface 30*a* of the conveyance belt (a lower surface in FIG. 2). Each of the head chips 9 is provided with a pressure chamber communicating with the plurality of ejection ports, a liquid channel, a common liquid chamber, to which ink is supplied from the ink tank, and an ejection energy generating element for generating ejection energy for ejecting, through the ejection ports, the ink to be supplied to the pressure chamber. In the present embodiment, a heat generation resistant element (i.e., a heater) for transducing electric energy to thermal energy is used as the ejection energy generating element. The heater is electrically connected to a controller 150 (see FIG. 3) via a drive circuit 140 (see FIG. 3), so that its drive and stoppage are controlled in response to an ON/OFF signal (i.e., an ejection/non-ejection signal) transmitted from the controller 150. The heater generates thermal energy during driving, so that the thermal energy produces bubbles in ink reserved in the pressure chamber, and then, the ink is ejected through the ejection ports owing to a pressure fluctuation at the moment.

A mist removing head (i.e., a mist removing unit) 14 is disposed downstream, as viewed from each of the print heads 11, in the conveyance direction (i.e., the direction E) of the print medium P. In the present embodiment, the mist removing head (i.e., a mist removing unit) 14 is disposed downstream of the ejection port array of each of the four print heads 11Y, 11M, 11C, and 11Bk. Consequently, the print heads 11 and the mist removing heads 14 are alternately arranged as a whole in the conveyance direction (i.e., the direction E) of the print medium P, as shown in FIG. 1A. Each of the mist removing heads 14 is disposed at a predetermined interval in a direction G (i.e., a vertical direction in FIG. 2) with respect to the upper surface 30*a* of the conveyance belt 30. A suction hole 7 and a blowing hole 8 are formed at a surface (i.e., a bottom surface) facing the upper surface 30*a* of the conveyance belt 30 in each of the mist removing heads 14. The suction hole 7 is formed downstream, as viewed from each of the print heads 11, in the conveyance direction of the print medium P. Moreover, the blowing hole 8 is formed downstream of the suction hole 7 in the conveyance direction of the print medium P. Air is jetted toward the print medium P from the blowing hole 8 so as to generate a vortex of gas downstream of the suction hole 7.

The suction hole 7 is connected to a suction pump for sucking air existing in a region S defined by the print head 11 and the print medium P through the suction hole 7. Furthermore, the blowing hole 8 is connected to a blowing pump (i.e., an air supply unit) for blowing air toward the region S through the blowing hole 8. Incidentally, the suction hole 7 and the suction pump constitute a suction unit whereas the blowing hole 8 and the blowing pump constitute a vortex generating unit for generating a vortex of gas.

Each of the suction hole 7 and the blowing hole in the present embodiment is formed into an elongated shape extending in the direction in which the ejection ports of each of the head chips 9 are arrayed (i.e., a widthwise direction, that is, the direction F), as shown in FIG. 1B. Each of the suction hole 7 and the blowing hole 8 has a longitudinal length m1, that is, a length in the direction (i.e., the direction F) perpendicular to the conveyance direction (i.e., the direction E) of the print medium P. The longitudinal length m1 of each of the suction hole 7 and the blowing hole 8 is greater than a length m2 (m1>m2), in which the ejection ports are arrayed at the print head 11. The formation range of the suction hole 7 and the blowing hole 8 encompasses the array range of the ejection ports in the widthwise direction (i.e., the direction F).

The conveyance belt 30 for conveying the print medium P is stretched between a drive roller 31 and a driven roller 32. The drive roller 31 is associated with a conveyance motor 111 (see FIG. 3). The conveyance motor 111 drives the drive roller 31 so as to rotate the drive roller 31 in a predetermined direction, and accordingly, the conveyance belt 30 is moved in the direction E. According to the movement of the conveyance belt 30, the print medium P held at the upper surface 30*a* of the conveyance belt 30 also is conveyed in the direction E. Here, the conveyance motor 111 and the conveyance belt 30 constitute a conveying unit according to the present invention. Moreover, the print medium P is designed to be held at the upper surface 30*a* of the conveyance belt 30 by a holding unit, not shown. Various types of holding units have been proposed and implemented so far. For example, there have been known a unit for electrically charging the upper surface of a conveyance belt so as to electrostatically adsorb a print medium and a unit for sucking a print medium from under a conveyance belt having air permeability so as to hold the print medium at the upper surface of the conveyance belt. Moreover, although the conveyance belt is used as the conveying unit in the present embodiment, the present invention is applicable to liquid ejecting apparatuses using conveying units other than the conveyance belt. For example, a liquid ejecting apparatus may be configured such that a print medium is supported by a flat platen facing a print head, and the rotation of a conveyance roller in contact with the print medium allows the print medium to be conveyed.

Figure 3:
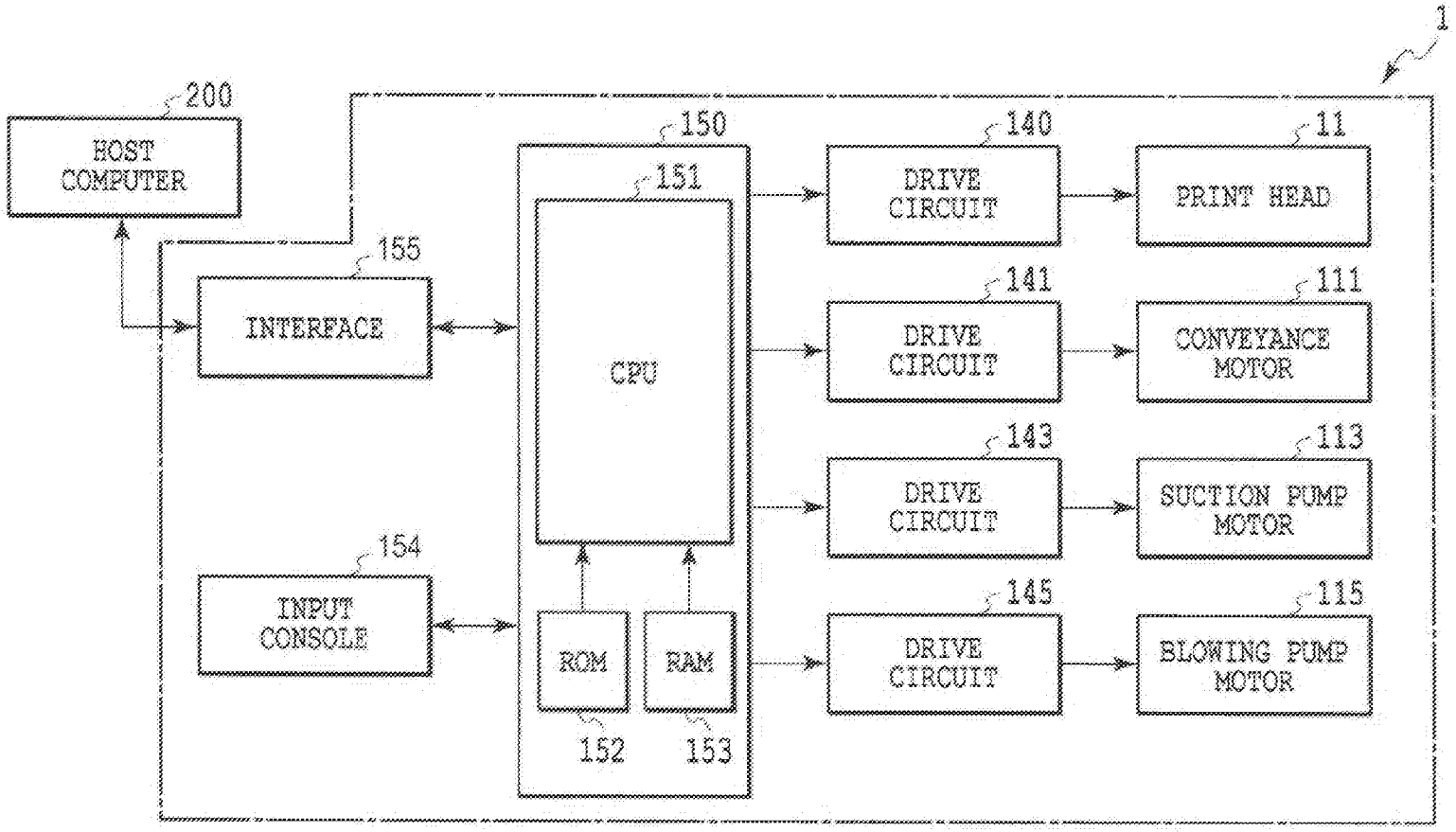
FIG. 3 is a block diagram illustrating the schematic configuration of a control system in the present embodiment.

FIG. 3 is a block diagram illustrating the schematic configuration of a control system in the present embodiment. In FIG. 3, the controller 150 functions as a control unit responsible for entirely controlling the liquid ejecting apparatus 1, and is connected to a host computer 200 via an interface 155. The controller 150 includes a CPU 151, a ROM 152, a RAM 153, and the like. The CPU 151 performs various kinds of processing such as calculation, determination, and control in accordance with a program stored in the ROM 152, and controls each of component parts in the liquid ejecting apparatus 1. The RAM 153 temporarily stores data output through an input console 154, and furthermore, functions as a work area for computations by the CPU 151.

To the controller 150 are connected the drive circuit 140 for driving each of the print heads 11 and drive circuits for driving various kinds of motors in the ink jet printing apparatus 1. For example, to the controller 150 is connected a conveyance motor 111 acting as a drive source for the conveyance belt 30 via a drive circuit 141. Moreover, to the controller 150 are connected drive circuits 143 and 145 for a suction pump motor 113 for driving the suction pump connected to the suction hole 7 and a blowing pump motor 115 for driving the blowing pump connected to the blowing hole 8.

In the liquid ejecting apparatus 1 having the above-described configuration, the drive roller 31 is rotated by the drive of the conveyance motor 111, and accordingly, the print medium P is conveyed in the conveyance direction (i.e., the direction E). While the print medium P is conveyed, liquid droplets (i.e., ink droplets) are ejected through the respective ejection ports of the print heads 11Y to 11Bk in accordance with print data, thus printing a color image. Not only main droplets contributive to image formation but also fine liquid droplets (i.e., mist) that are not contributive to the image formation are ejected through the respective ejection ports of the print heads 11 during a printing operation. The fine liquid droplets float in the region S without landing on the print medium. The mist 12 adheres to various portions such as a surface (i.e., an ejection port surface) of the print head 11 at which the ejection ports are formed and the print medium, thereby degrading the ejection performance of the print head 11 or smudging the print medium and the printing apparatus. In view of the above, it is necessary to remove the mist generated between the print head 11 and the print medium P in the ink jet printing apparatus.

Figure 4A:
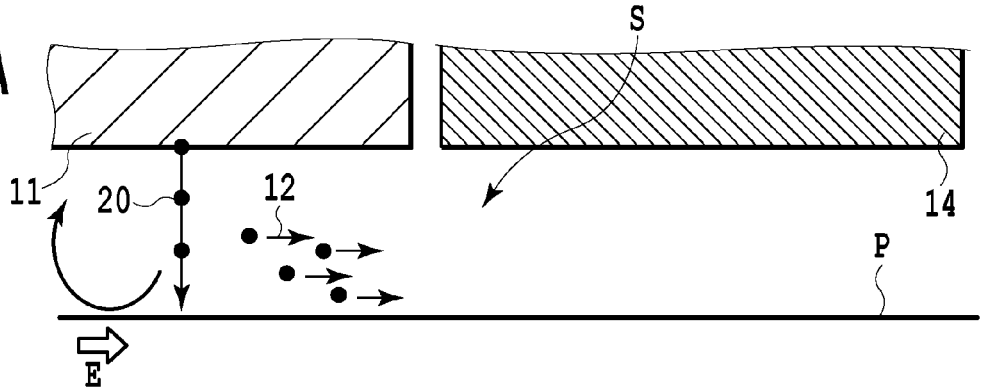
FIGS. 4A to 4D are schematic views showing the flow and vortex of mist generated in a first embodiment.
Figure 4B:
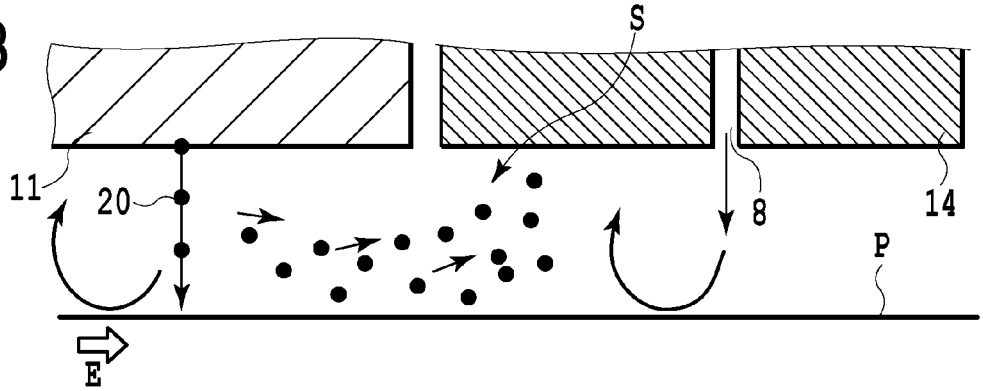

FIGS. 4A to 4D are schematic views showing the behaviors of the airflow and the mist that are generated between the print head 11 and the print medium P. As shown in FIG. 4A, the mist 12 generated at the ejection port array is fed on the airflow in the conveyance direction (i.e., the direction E in FIG. 1A), the airflow being generated by the conveyance operation of the print medium P downstream in the conveyance direction. Moreover, FIG. 4B is a schematic view showing the blown state of the airflow toward the print medium P from the blowing hole 8 of the mist removing head 14 downstream of the print head 11. The airflow blown through the blowing hole 8 abuts against the print medium P, flows upward, and then, forms a vortex. In a case where the air is properly blown, it is possible to prevent any leakage of the mist 12 downstream. Here, the mist 12 is fed in the array direction of the ejection ports (i.e., the direction perpendicular to the sheet of FIGS. 4A to 4D, that is, the direction F shown in FIG. 1B). Consequently, at the print head 11, the suction holes are formed at lateral positions in the conveyance direction so as to suck the air therethrough, thus removing the mist flowing in the ejection port array direction. However, in this case, since a flying distance of the mist 12 to the suction hole becomes longer, the mist frequently adheres to the print head 11 or the mist removing head 14.

Figure 4C:
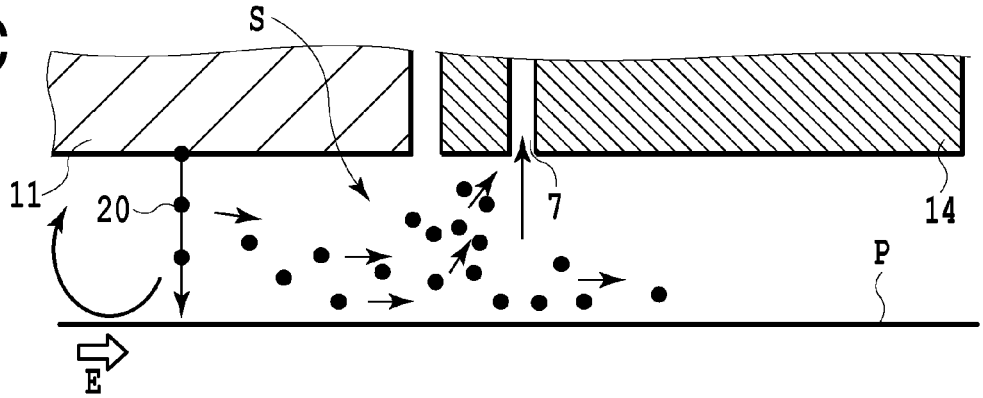

Furthermore, FIG. 4C is a schematic view showing a case where only the suction hole 7 removes the mist. In this case, the mist 12 fed on the airflow produced by the movement of the print medium P needs to be removed, and therefore, the air needs to be sucked by a strong suction force. A main droplet 20 ejected from the print head 11 is adversely influenced by the airflow toward the suction hole 7, and therefore, the landing position on the print medium P is misregistered, thereby possibly degrading an image.

Figure 4D:
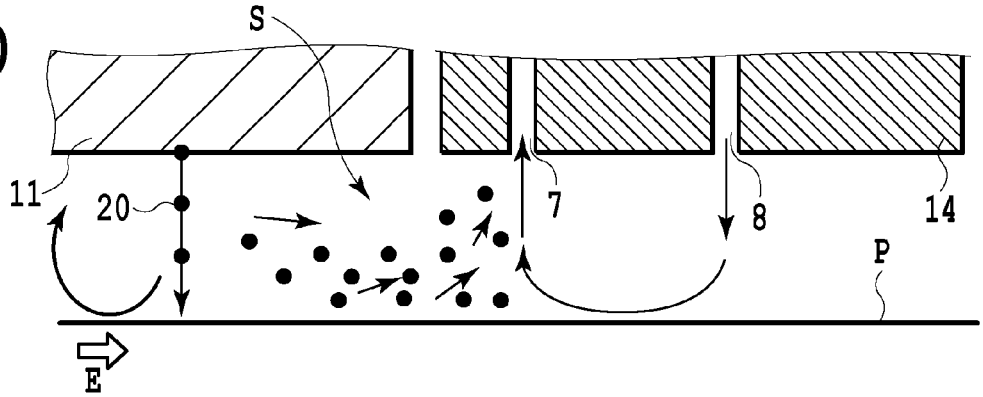

In the present embodiment, in order to efficiently remove the mist without any influence on the landing position of the main droplet 20 ejected from the print head 11, the air blowing through the blowing hole 8 and the air suction through the suction hole 7 are designed to be performed at the same time, as shown in FIG. 4D. Thus, the airflow produced by the air blown through the blowing hole 8 inhibits the mist 12 from moving downstream in the conveyance direction. The mist 12 floating in the vicinity of the print medium P is swirled up by the air blown through the blowing hole 8, and then, is sucked into the suction hole 7, thereby reducing the adhesion of the mist 12 to the print medium P. Furthermore, as described below, setting various parameters enables most part of the airflow formed by the air blown through the blowing hole 8 to be sucked into the suction hole 7, and thus, most of the mist can be sucked into the suction hole 7 on the airflow. Eventually, it is possible to remarkably reduce a smudge on the print head 11 or its surroundings and a smudge on the print medium P.

Figure 5:
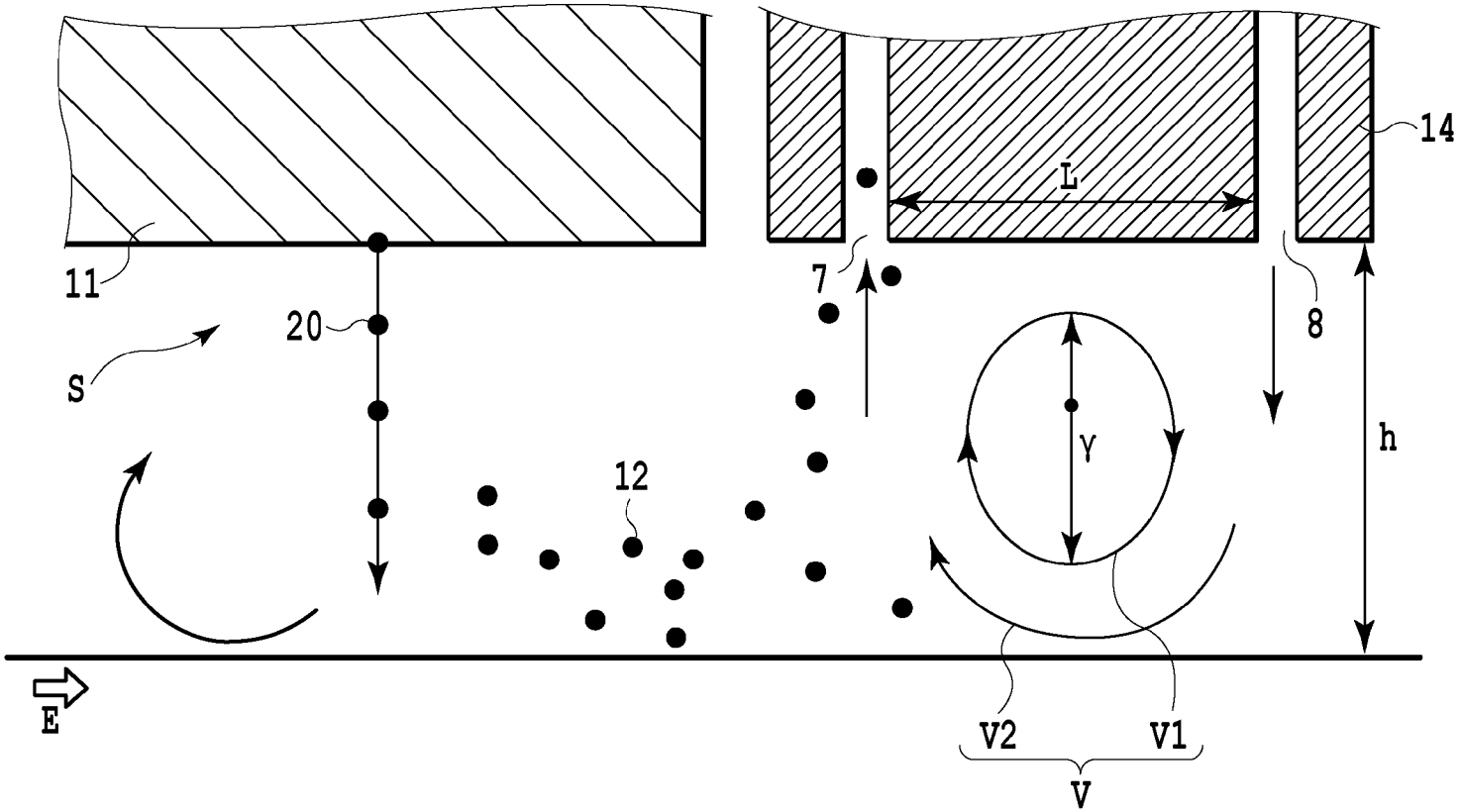
FIG. 5 is a schematic view showing the configuration of essential parts and the behavior of the mist in the first embodiment.

FIG. 5 is a schematic view showing an airflow generation state in which the mist 12 can be efficiently absorbed in a case where the mist 12 is removed by blowing the air through the blowing hole 8 and sucking the air through the suction hole 7 at the same time. The present inventors confirmed that mist removal efficiency is varied according to an interval L between the suction hole 7 and the blowing hole 8, a suction quantity, and a blowing quantity. In view of this, simulation was performed by using, as parameters, the interval between the suction hole 7 and the blowing hole 8, a flow rate of air to be blown, an interval between the print medium P and the print head 11, and the like. As a result, the present inventors found the characteristic fluidity mode of an airflow that enabled the efficient mist removal.

As shown in FIG. 5, the air suction and the air blowing are performed at the same time, so that a vortex V is produced between the suction hole 7 and the blowing hole 8, as shown in FIG. 5. Here, explanation is made on the vortex V. The vortex V produced between the suction hole 7 and the blowing hole 8 is called a Rankine vortex. The Rankine vortex V consists of a forcible vortex region V1 at the center and a free vortex region V2 outside of the center. The forcible vortex region V1 has a linear speed distribution, and therefore, the region can be relatively easily specified. A radius γ of the forcible vortex region V1 is called a vortex core radius. In the present embodiment, the shape of the vortex V produced between the suction hole 7 and the blowing hole 8 is asymmetric. Here, a maximum value of two vortex core radii γ in the perpendicular direction from the center of the vortex V with respect to the print medium P is defined as a maximum vortex core radius. Incidentally, the vortex V produced between the print head 11 and print medium P can be measured based on visible measurement. One skilled in the art can readily measure the vortex V. The present inventors mainly made simulation, and consequently, found the four conditions under which the mist could be efficiently removed.

[Condition 1]

The maximum vortex core radius γ is ⅓ or more of a distance h (mm) between the print medium P and the mist removing head 14.

[Mathematic Formula 2]

$$\gamma \geq h/3 \quad (1)$$

[Condition 2]

Suction or blowing airflow rate v (m/s) and the shortest distance (L (mm) in FIG. 5) between the blowing hole 8 and the suction hole 7 within the range satisfying Expression (1) satisfies a relationship expressed by the following expression (2):

[Mathematic Formula 3]

$$v \leq -1.82L + 28.2 \quad (2)$$

[Condition 3]

It is preferable that L should be three times or less of h in order to produce the vortex V that can efficiently remove the mist.

[Mathematic Formula 4]

$$3h \geq L \quad (3)$$

[Condition 4]

In a case where the suction or blowing airflow rate v (m/s) is 10 m/s or lower, the mist can be removed without disturbing the ambient airflow.

[Mathematic Formula 5]

$$10 \geq v \quad (4)$$

These relational expressions will be explained with reference to FIGS. 6A to 6E. In FIGS. 6A, 6B, 6C, 6D, and 6E, the vertical axis represents the suction or blowing airflow rate v [m/s] whereas the lateral axis represents the shortest distance L [mm] between the suction hole 7 and the blowing hole 8 at the mist removing head 14. Simulations of air fluidity modes between the print medium P and the print head 11 or the mist removing head 14 were carried out under various conditions, so as to determine whether or not the mist could be removed. Among them, FIGS. 6A to 6E are diagrams illustrating the air fluidity modes most typifying the characteristics of the present embodiment.

As to the conditions of the simulations illustrated in FIGS. 6A to 6E, the suction or blowing airflow rates were set to have the same value; the distance h between print medium P and the mist removing head 14 was set to 1.25 mm; a width of each of the suction hole 7 and the blowing hole 8 was set to 0.5 mm; and the speed of the print medium was set to 0.635 m/s.

The upper limits of the air suction rate and the air blowing rate fall within a range in which the disturbance of the airflow produced between the mist removing head 14 or the print head 11 and the print medium P does not become large. This is because in a case where the disturbance of the airflow is large, the mist 12 adheres to the print head 11 or the mist removing head 14 or the mist is insufficiently removed from the mist removing head 14. In the scope of the present embodiment, in a case where, in particular, the air blowing rate exceeds 20 m/s, the disturbance of the airflow produced between the print head 11 and the print medium P becomes large, thereby making it difficult to remove the mist. In view of this, the present embodiment illustrates an example in which the blowing rate was set to 20 m/s or less. The distance h between the print medium P and the mist removing head 14 was set from 1.0 mm to 2.0 mm. The fluidity modes shown in FIGS. 4A to 4D were confirmed in this manner.

Next, explanation will be made on the distance L between the suction hole 7 and the blowing hole 8. In order to securely remove the mist 12, it is necessary that the vortex V generated between the mist removing head 14 and the print medium P stably exists. An aspect ratio L/h of the region S in which the vortex V exists is important to the stable existence of the vortex V. In a case where the aspect ratio is large, the vortex V cannot stably exist, and therefore, the vortex V is fragmented into several vortexes or becomes unstable. In view of this, in the present embodiment, the aspect ratio was about 8 or less, that is, the distance between the blowing hole 8 and the suction hole 7 was 10 mm or less. Moreover, also in a case where the conveyance speed of the print medium was 2.0 m/s, substantially the same fluidity modes as those illustrated in FIGS. 6A to 6E were confirmed.

Figure 6A:
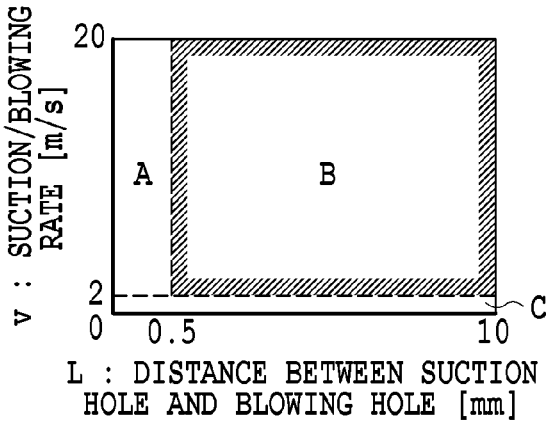
FIGS. 6A to 6E are schematic graphs illustrating the behavior of the mist in a case where a distance between a suction hole and a blowing hole and the air suction and blowing rate are varied.

A region in terms of a diagram represented by Expression (1) is illustrated in FIG. 6A. The region represented by Expression (1) is a region B. In a region A, since the distance L between the suction hole 7 and the blowing hole 8 is short, a vortex generated therebetween does not satisfy Expression (1). In a region C, the blowing rate is 2 m/s or less. In a case where the blowing rate is 2 m/s or less, the influence of cockling (flexure) caused by the movement of the print medium P may make the flow of gas between the mist removing head 14 and the print medium P unstable, thereby preventing the stable removal of the mist 12. In addition, in the region C, since the arrival distance of the airflow at the print medium P is short, a vortex that satisfies the relationship of Expression (1) cannot be possibly generated between the suction hole 7 and the blowing hole 8.

Subsequently, the condition under which the mist can be much preferably removed will be explained with reference to FIG. 6B. The region B and a region D are separated from each other based on Expression (2). In other words, since the blowing rate is high in the region D, the flow is inconstant. As the flow becomes more inconstant, the vortex V generated between the blowing hole 8 and the suction hole 7 becomes unstable, thereby possibly preventing the removal of a part of the mist 12. As a result, it is preferable that the mist should be removed within the region B in FIG. 6B in which Expressions (1) and (2) are applied.

Figure 6D:
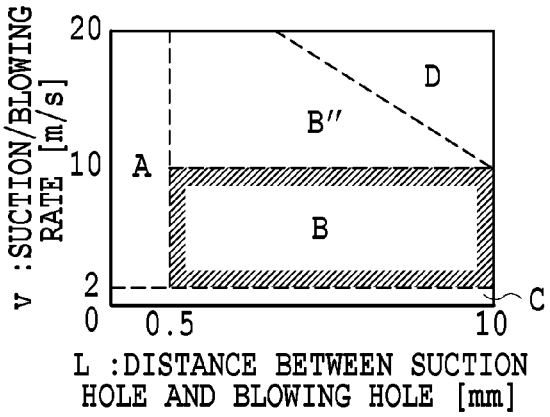
Figure 6B:
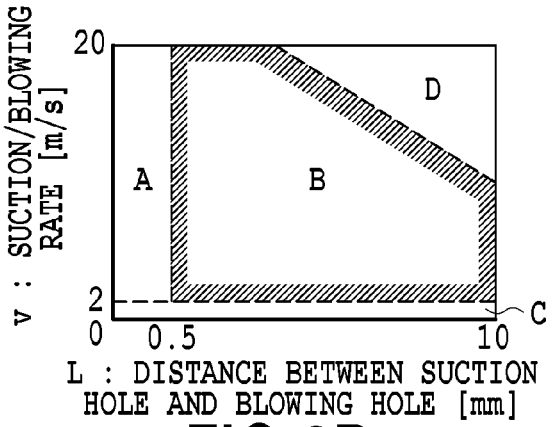
Figure 6E:
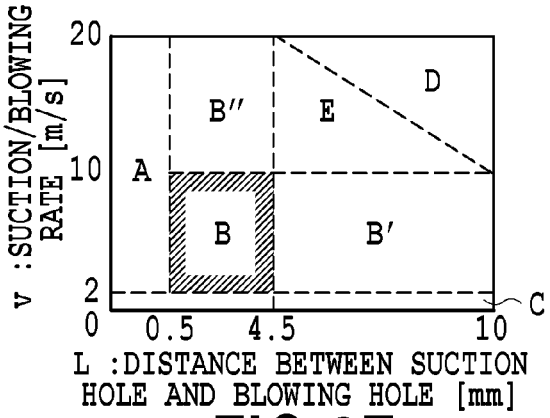
Figure 6C:
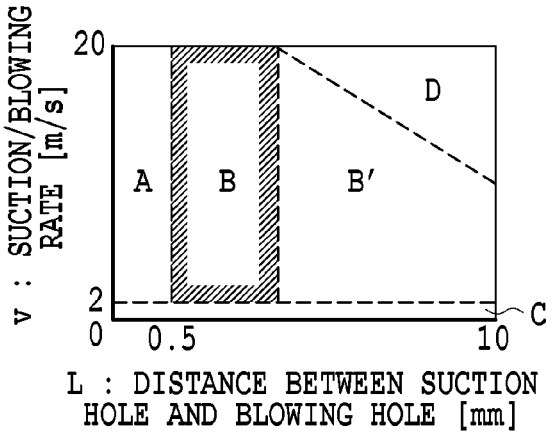

FIG. 6C illustrates a case where Expression (3) is applied to the region B represented by Expression (1) in FIG. 6A. Here, the region B illustrated in FIG. 6B is divided into the region B and a region B'. A part of the mist 12 may adhere to the print head 11 in the region B'. That is to say, it is desirable that the mist should be removed within a range to which Expressions (1) and (3) are applied.

FIG. 6D illustrates a case where Expression (4) is applied to the region B represented by Expression (1) in FIG. 6B. The region B illustrated in FIG. 6B is divided into the region B and a region B" in FIG. 6D. There is a possibility in the region B" that a part of the mist 12 cannot be removed, and then, flows downstream of the print head 11. Consequently, it is desirable that the mist should be removed within a range to which Expressions (1) and (4) are applied.

FIG. 6E illustrates a case where Expressions (3) and (4) are applied to the region B represented by Expression (1) in FIG. 6A. The region B in FIG. 6A is divided into regions B', B", D, and E. A part of the mist may adhere to the print head 11 in the region B'. There is a possibility in the region B" that a part of the mist cannot be removed, and then, flows downstream of the print head 11. In the region E, a part of the mist 12 may adhere to the print head 11 or a part of the mist cannot be removed, and then, flows downstream of the print head 11. Consequently, it is desirable that the mist should be removed within a range in which Expressions (3) and (4) are applied to Expression (1).

Second Embodiment

Figure 7A:
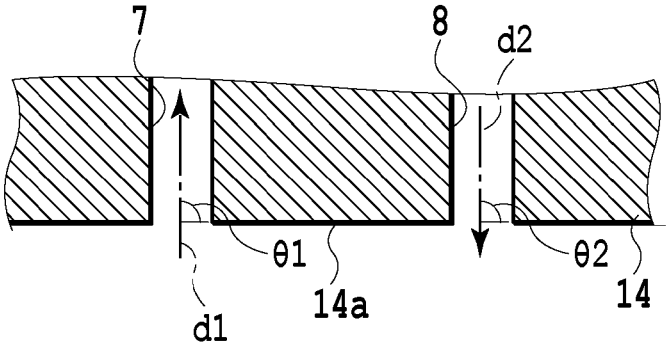
FIGS. 7A to 7D are schematic views showing the orientations of a blowing hole and a suction hole in a second embodiment.

Next, a description will be given of a second embodiment according to the present invention. In the first embodiment, an angle θ1 defined by a direction d1 of the airflow in the suction hole 7 at the mist removing head and a head surface 14*a* and an angle θ2 defined by a direction d2 of the airflow in the blowing hole 8 and the head surface 14*a* are equal to each other (90 degrees), as shown in FIG. 7A. In contrast, in the second embodiment, the angle θ1 defined by the head surface 14*a* and the direction d1 of the airflow in the suction hole 7 and the angle θ2 defined by the head surface 14*a* and the direction d2 of the airflow in the blowing hole 8 are different from each other, as shown in FIGS. 7B to 7D.

Figure 7B:
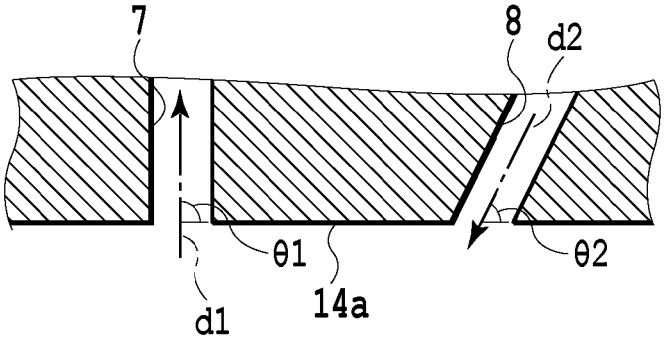
Figure 7C:
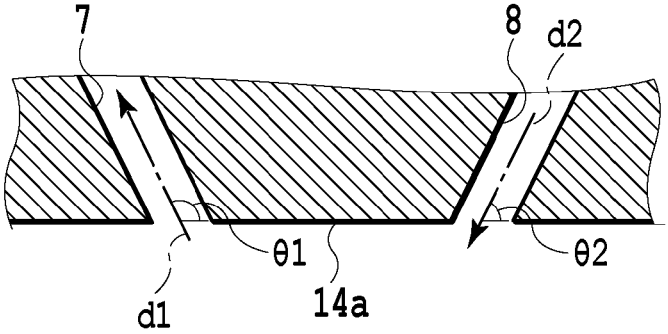
Figure 7D:
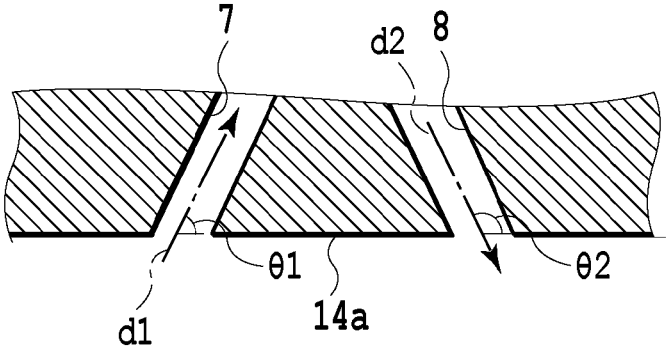

As shown in FIGS. 7B to 7D, the suction hole 7 and the blowing hole 8 in the mist removing head 14 can be formed at various angles in various directions with respect to the head surface 14*a*. Moreover, it is unnecessary that the airflow rate at the suction hole 7 is equal to that at the blowing hole 8. Additionally, a surface between the suction hole 7 and the blowing hole 8 need not be flat, and therefore, it may be recessed or projected. Even if the air is blown and sucked at the mist removing head 14 at any angles and any flow rates in any directions. Expression (1) is only required to be established, so that the mist can be removed. In order to more securely remove the mist, it is desirable that the mist 12 should be removed within the range in which Expressions (2) and (3) are established in addition to the establishment of Expression (1).

Third Embodiment

Figure 8A:
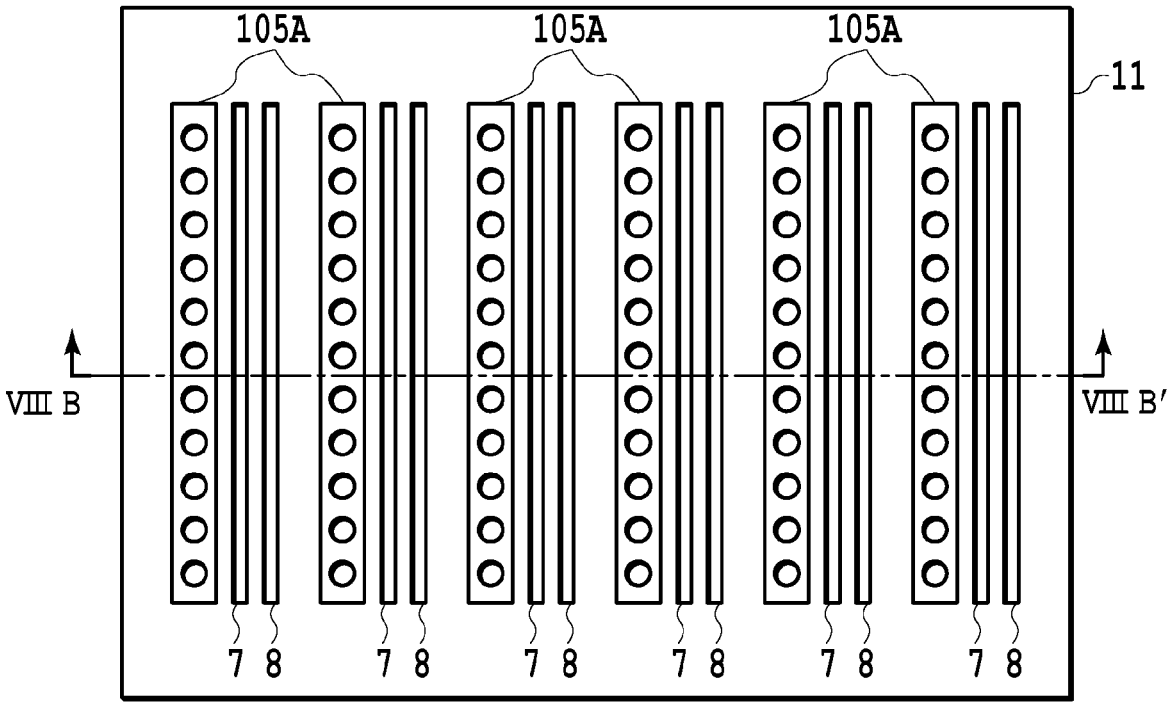
FIG. 8A is a bottom view schematically showing the configuration of a print head 11 in a third embodiment, wherein an ejection port, an air suction hole, and an air blowing hole are shown.
Figure 8B:
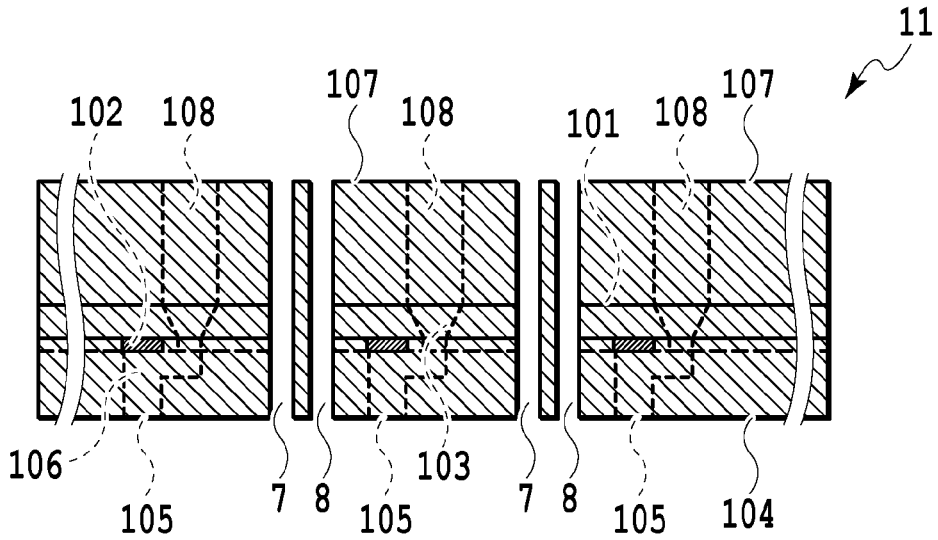
FIG. 8B is a cross-sectional view taken along a line VIIIB-VIIIB' of FIG. 8A.

Subsequently, a description will be given of a third embodiment according to the present invention with reference to FIGS. 8A and 8B. FIG. 8A is a bottom view schematically showing the configuration of the print head in the present embodiment; and FIG. 8B is a cross-sectional view taken along a line VIIIB-VIIIB' of FIG. 8A. The above-described first and second embodiments are configured such that the plurality of print heads (11Y, 11C, 11M, and 11Bk) are disposed, and furthermore, the mist removing heads 14, each having the suction hole 7 and the blowing hole 8, are disposed independently of the print heads 11 downstream of each of the plurality of print heads. In contrast, in the third embodiment, a plurality of ejection port arrays 105A for ejecting different color inks are formed inside of a single print head 11, as shown in FIG. 8A. A blowing hole 8 and a suction hole 7 are formed in parallel downstream of each of the ejection port arrays 105A.

Moreover, as shown in FIG. 8B, the print head 11 is provided with a substrate 101 having a heater 102 as an ejection energy generating element for ejecting liquid, an ejection port 105 for ejecting liquid, and an ejection port forming member 104 having a foaming chamber 106 communicating with the ejection port 105. Furthermore, the print head 11 includes a support member 107 having a liquid supply channel 108 communicating with a liquid supply port 103 formed at the substrate 101. In this manner, a print head in the present embodiment is configured such that liquid is heated and foamed with heat generated by the heater 102 so as to eject the liquid. However, the present invention is applicable to a print head adopting a configuration in which liquid is ejected by using an electromechanical transducer such as a piezoelectric element.

Like the third embodiment, the integral formation of the suction hole 7 and the blowing hole 8 for removing mist with the print head 11 can reduce the entire dimension of the print head 11 in a print medium conveyance direction (i.e., a direction E). Moreover, mist generated at each of the ejection port arrays 105A can be removed at a position nearer the ejection port array. Consequently, immediately after the mist is generated inside of the print head, that is, before the mist is diffused, the mist can be rapidly removed, thus more effectively reducing a smudge caused by the mist.

Fourth Embodiment

Next, a fourth embodiment according to the present invention will be explained with reference to FIGS. 9A to 9C, 10A, and 10B. The fourth embodiment shows constitutional examples of a suction unit and a blowing unit for sucking air at the suction hole 7 and blowing air at the blowing hole 8, respectively, in the liquid ejecting apparatus 1 in the above-described first to third embodiments.

Figure 9A:
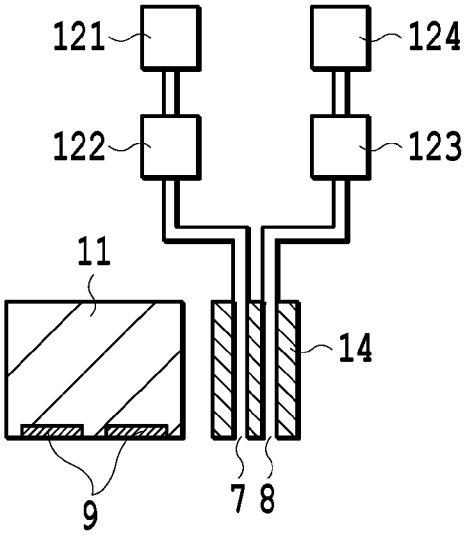
FIG. 9A is a schematic view showing a first example of a fourth embodiment.

FIG. 9A shows a first example in which a suction pump 121 for sucking air is connected to a suction hole 7 at a mist removing head 14 whereas a blowing pump (i.e., the blowing unit) 123 is connected to a blowing hole 8. In this case, it is desirable that a filter 122 should be disposed between the suction hole 7 and the suction pump 121, and furthermore, a filter 124 should be disposed upstream of the blowing pump 123. The filters 122 and 124 are adapted to remove dust.

Figure 9B:
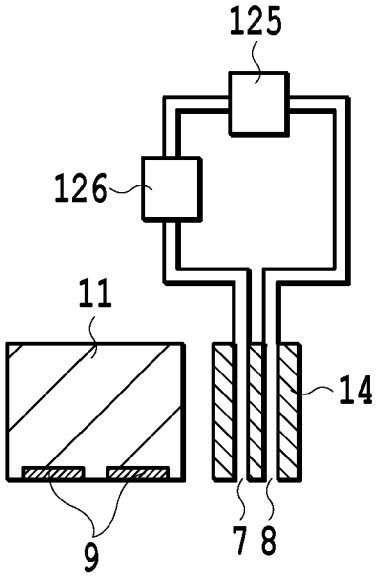
FIG. 9B is a schematic view showing a second example of the fourth embodiment.

Moreover, FIG. 9B shows a second example in which the use of a single pump 125 achieves air suction at the suction hole 7 and air blowing at the blowing hole 8. Specifically, in the second example, the suction hole 7 is connected to a suction port of the pump 125 via a dust removing filter 126, and furthermore, the blowing hole 8 is connected to an air supply port formed at the same pump 125. The air suction flow rate at the suction hole 7 is substantially the same as the air blowing flow rate at the blowing hole 8, the flow rates satisfying the relationship expressed by Expression (1). Consequently, the air discharged through the air supply port of the pump 125 may be utilized as air to be blown from the blowing hole 8.

Figure 9C:
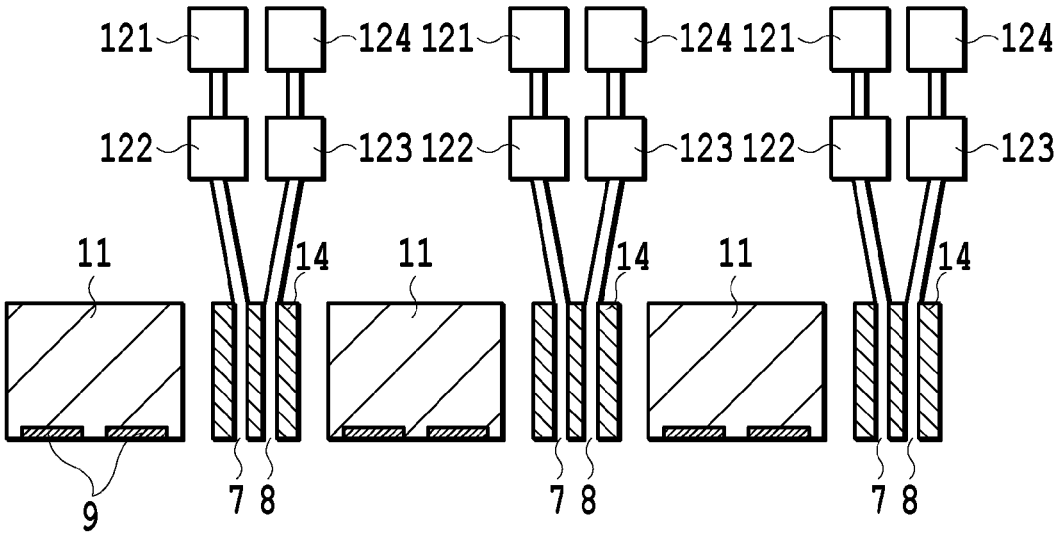
FIG. 9C is a schematic view showing a third example of the fourth embodiment.

FIG. 9C shows an example (i.e., a third example) in which a suction pump 121 and a blowing pump 123 are connected in a liquid ejecting apparatus in which a plurality (three in FIG. 9C) of print heads 11 arranged in the conveyance direction of a print medium are arranged in parallel to each other, and furthermore, a mist removing head 14 is disposed sideways of each of the print heads 11. Also in the third example, a suction pump 121 for sucking air is connected to a suction hole 7 at the mist removing head 14 whereas a blowing pump (i.e., the blowing unit) 123 is connected to a blowing hole 8, like in the first example.

Figure 10A:
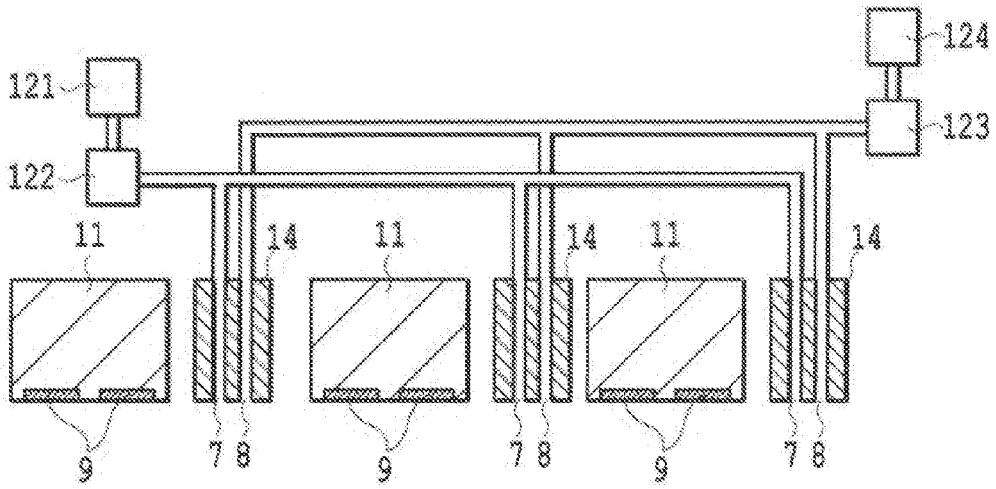
FIG. 10A is a schematic view showing a fourth example of the fourth embodiment.
Figure 10B:
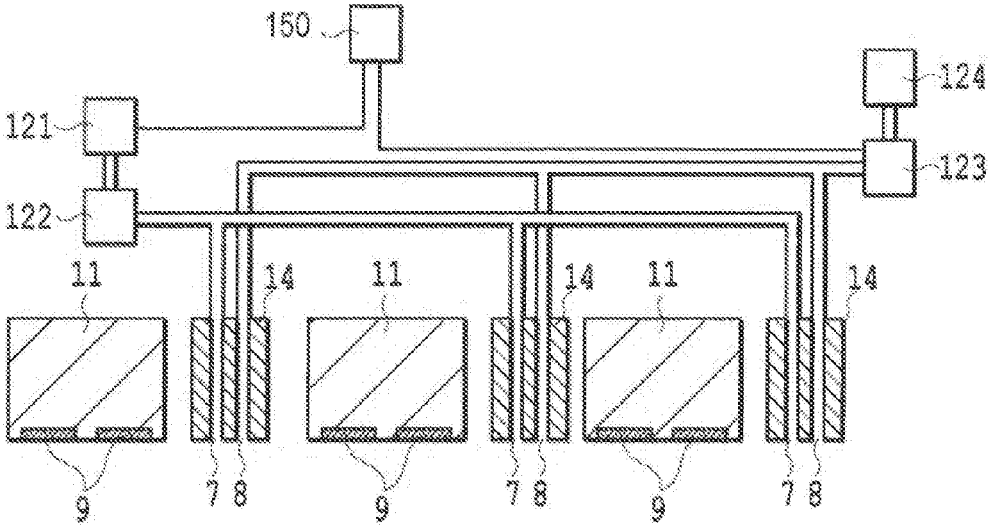
FIG. 10B is a schematic view showing a fifth example of the fourth embodiment.

In addition, like a fourth example shown in FIG. 10A, a suction hole 7 of each of a plurality of mist removing heads 14 may be connected to a suction port formed at a single suction pump 121 via a filter 122, and furthermore, each of blowing holes 8 may be connected to an air supply port formed at a single blowing pump 123. Moreover, like a fifth example shown in FIG. 10B, the controller 150 may control an air suction quantity by the suction pump 121 connected to each of the suction holes 7 and a blowing quantity by the blowing pump 123 according to the number of liquid droplets to be ejected from a print head.

Fifth Embodiment

Figure 11:
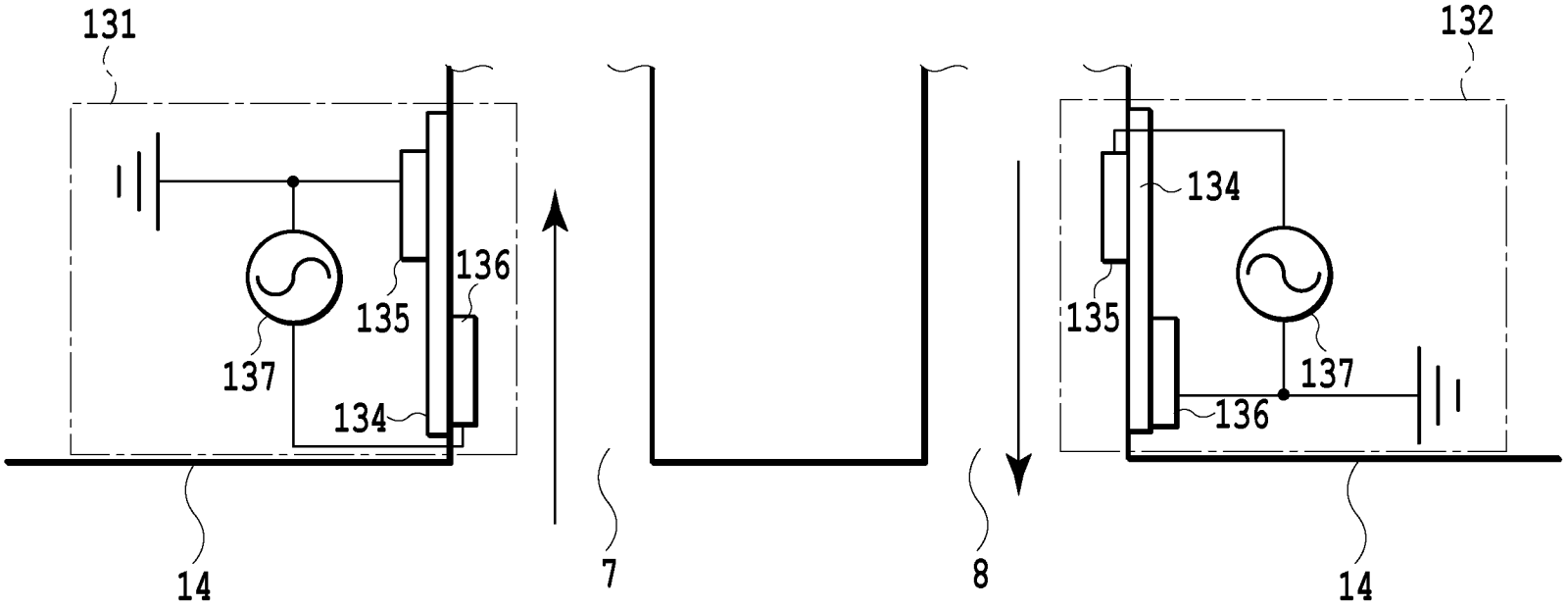
FIG. 11 is a schematic view showing essential parts in a fifth embodiment.

Next, a description will be given of a fifth embodiment according to the present invention. In the fifth embodiment, an air sucking unit for generating an airflow on which mist is sucked through a suction hole 7 and an air supply unit for supplying air through a blowing hole 8 include plasma actuators 131 and 132, respectively, as shown in FIG. 11. The plasma actuators 131 and 132 are disposed at the respective inner surfaces of the suction hole 7 and the blowing hole 8 at a mist removing head 14. In each of the plasma actuators 131 and 132, a dielectric 134 is held by a pair of electrodes 135 and 136, and furthermore, an AC voltage output from a high frequency generator 137 serving as an AC power source is applied to between the electrodes 135 and 136. In this manner, the airflows can be generated in constant directions with respect to the suction hole 7 and the blowing hole 8.

In this manner, the fifth embodiment is configured such that the airflows inward along the inner surface of the suction hole 7 by one plasma actuator 131 whereas the air is blown along the inner surface of the blowing hole 8 by the other plasma actuator 132. Alternatively, a dielectric may be cylindrically disposed along the respective inner circumferential surfaces of the suction hole 7 and the blowing hole 8, and furthermore, a plurality of electrodes may be arranged along both of inner and outer circumferential surfaces of the dielectric.

The use of the plasma actuators 131 and 132 enables an airflow to be generated even in a narrow space. Moreover, the fifth embodiment does not need any large-sized apparatus such as a pump, thus miniaturizing the liquid ejecting apparatus 1. Additionally, the airflow rate of the plasma actuators 131 and 132 can be readily adjusted by controlling a voltage to be applied to the electrode and frequency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-056175, filed Mar. 19, 2015, and No. 2016-027008, filed Feb. 16, 2016, which are hereby incorporated by reference wherein in their entirety.

What is claimed is:

1. A liquid ejecting apparatus including a moving unit configured to make a relative movement between at least one liquid ejecting unit, having an ejection port for ejecting liquid, and a print medium, the print medium being placed at a predetermined interval with respect to the liquid ejecting unit, the liquid ejecting apparatus comprising:

at least one mist removing unit provided downstream of the at least one liquid ejecting unit in a movement direction in which the print medium is moved in the case of relative movement, the mist removing unit comprising:

at least one suction hole configured to suck air existing in a region defined by the liquid ejecting unit and the print medium together with mist; and at least one blowing hole that is formed downstream of the suction hole in the movement direction, the blowing hole configured to blow air toward the print medium so as to generate a vortex of gas downstream of the suction hole, wherein a relationship expressed by the following expression is satisfied:

$$\gamma \geq h/3$$

where γ represents a maximum vortex core radius (mm) of the vortex in a direction perpendicular to the print medium, and h represents a distance (mm) between the mist removing unit and the print medium, and wherein a relationship expressed by the following expression is satisfied:

$$v \leq -1.82L + 28.2$$

where L represents a distance (mm) between the suction hole and the blowing hole, v represents a rate (m/s) of an airflow produced by blowing air through the blowing hole, and the constant values of −1.82 and 28.2 in the relationship have units of (m/(s·mm)) and (m/s), respectively.

2. The liquid ejecting apparatus according to claim 1, wherein a rate of each of an airflow produced by sucking air through the suction hole and the airflow produced by blowing air through the blowing hole is 20 (m/s) or less, and the shortest distance between the suction hole and the blowing hole is 10 (mm) or less.

3. The liquid ejecting apparatus according to claim 1, wherein a relationship expressed by the following expression is satisfied:

$$3h \geq L$$

where h represents the distance (mm) between the mist removing unit and the print medium, and L represents the distance (mm) between the suction hole and the blowing hole.

4. The liquid ejecting apparatus according to claim 1, wherein the rate v satisfies the following expression:

$$10 \geq v$$

where the constant in the expression has units of (m/s).

5. The liquid ejecting apparatus according to claim 1, further comprising:

an air suction unit configured to suck air through the suction hole; and an air supply unit configured to blow air through the blowing hole.

6. The liquid ejecting apparatus according to claim 5, wherein at least one of the air suction unit and the air supply unit includes a pump.

7. The liquid ejecting apparatus according to claim 6, wherein a plurality of liquid ejecting units are arrayed in the movement direction, the suction hole and the blowing hole are arranged, in order, on each of a plurality of mist removing units provided downstream of each of the plurality of liquid ejecting units, respectively, a plurality of suction holes respectively arranged downstream of the plurality of liquid ejecting units are connected to a first single pump, and a plurality of blowing holes are connected to a second single pump.

8. The liquid ejecting apparatus according to claim 7, wherein the plurality of suction holes are connected to a suction port of the first single pump, and the plurality of blowing holes are connected to an air supply port of the second single pump.

9. The liquid ejecting apparatus according to claim 5, wherein the ejection port, the suction hole, and the blowing hole are formed on an identical substrate.

10. The liquid ejecting apparatus according to claim 5, wherein at least one of the air suction unit and the air supply unit includes a plasma actuator.

11. The liquid ejecting apparatus according to claim 10, wherein the plasma actuator includes electrodes disposed at one surface of a dielectric and another surface thereof, and an AC power source configured to apply an AC voltage between the electrodes.

12. A liquid ejecting apparatus including a moving unit configured to make a relative movement between at least one liquid ejecting unit, having an ejection port for ejecting liquid, and a print medium, the print medium being placed at a predetermined interval with respect to the liquid ejecting unit, the liquid ejecting apparatus comprising:

at least one mist removing unit provided downstream of the at least one liquid ejecting unit in a movement direction in which the print medium is moved in the case of relative movement, the mist removing unit comprising:

at least one suction hole configured to suck air existing in a region defined by the liquid ejecting unit and the print medium together with mist; and at least one blowing hole that is formed downstream of the suction hole in the movement direction, the blowing hole configured to blow air toward the print medium so as to generate a vortex of gas downstream of the suction hole, wherein a relationship expressed by the following expression is satisfied:

$$\gamma \geq h/3$$

where γ represents a maximum vortex core radius (mm) of the vortex in a direction perpendicular to the print medium, and h represents a distance (mm) between the mist removing unit and the print medium, and wherein a relationship expressed by the following expression is satisfied:

$$3h \geq L$$

where h represents the distance (mm) between the mist removing unit and the print medium, and L represents a distance (mm) between the suction hole and the blowing hole.

13. The liquid ejecting apparatus according to claim 12, wherein a relationship expressed by the following expression is satisfied:

$$v \leq -1.82L + 28.2$$

where L represents the distance (mm) between the suction hole and the blowing hole v represents a rate (m/s) of an airflow produced by blowing air through the blowing hole, and the constant values of −1.82 and 28.2 in the relationship have units of (m/(s·mm)) and (m/s), respectively.

14. The liquid ejecting apparatus according to claim 12, wherein a rate of each of an airflow produced by sucking air through the suction hole and an airflow produced by blowing air through the blowing hole is 20 (m/s) or less, and the shortest distance between the suction hole and the blowing hole is 10 (mm) or less.

15. The liquid ejecting apparatus according to claim 13, wherein the rate v satisfies the following expression:

$$10 \geq v$$

where the constant in the expression has units of (m/s).

16. The liquid ejecting apparatus according to claim 12, further comprising:

an air suction unit configured to suck air through the suction hole; and an air supply unit configured to blow air through the blowing hole.

17. The liquid ejecting apparatus according to claim 16, wherein the ejection port, the suction hole, and the blowing hole are formed on an identical substrate.

18. The liquid ejecting apparatus according to claim 16, wherein at least one of the air suction unit and the air supply unit includes a plasma actuator.

19. The liquid ejecting apparatus according to claim 18, wherein the plasma actuator includes electrodes disposed at one surface of a dielectric and another surface thereof, and an AC power source configured to apply an AC voltage between the electrodes.

* * * * *